United States Patent [19]

Yamagishi et al.

[11] Patent Number: 4,868,041

[45] Date of Patent: Sep. 19, 1989

[54] CLOTH FOR PROTECTION AGAINST FLAMES

[75] Inventors: Mashiro Yamagishi, Osaka; Takumi Minagawa, Ohtsu; Hiroshi Yoshida, Ise, all of Japan

[73] Assignee: Toyo Boseki Kabushiki Kaisha, Osaka, Japan

[21] Appl. No.: 153,914

[22] Filed: Feb. 9, 1988

[30] Foreign Application Priority Data

Feb. 9, 1987 [JP] Japan ..... 62-27924

[51] Int. Cl.[4] ..... B32B 7/00

[52] U.S. Cl. ..... 428/254; 428/267; 428/270; 428/274; 428/276; 428/373; 428/377; 428/393; 428/395; 428/921

[58] Field of Search ..... 428/254, 267, 270, 274, 428/276, 373, 377, 393, 395, 921

[56] References Cited

U.S. PATENT DOCUMENTS

| | | | |
|---|---|---|---|
| 4,265,981 | 5/1981 | Campbell | 428/377 |
| 4,610,905 | 9/1986 | von Bücher et al. | 428/921 |
| 4,755,407 | 7/1988 | Mortensen et al. | 428/921 |
| 4,780,359 | 10/1988 | Trask et al. | 428/921 |

*Primary Examiner*—Marion C. McCamish

*Attorney, Agent, or Firm*—Wegner & Bretschneider

[57] ABSTRACT

Cloth for protection against flames which comprises woven or knitted composite yarns wherein wholly aromatic polyamide fibers of a general formula;

$$-NHAr_1NHCOAr_2CO- \text{ and/or } -NHAr_3CO-$$

wherein $Ar_1$, $Ar_2$ and $Ar_3$ are independently bivalent aromatic groups, respectively, are disposed as cores and flameproofed cellulosic fibers and/or wool fibers are disposed around said cores.

7 Claims, 1 Drawing Sheet

CLOTH FOR PROTECTION AGAINST FLAMES

FIELD OF THE INVENTION

The present invention relates to cloth having excellent protective property against flames suitable for clothes to be put on at places where a person may be exposed to a high temperature or flames for a moment, for example, fire fighting ranger's clothes, fireman's coat, special clothes for policemen, rescuer's clothes, racer's clothes, military uniforms and pilot's suits as well as fireproofing clothes and furnace operator's clothes in the field of oil, gas, electricity and iron industries.

BACKGROUND OF THE INVENTION

Heretofore, flameproofed cotton cloth or wool cloth, or cloth of wholly aromatic polyamide fibers in which the raw material itself has fire retardance has been used for clothes to be put on at places where a person may be exposed to a high temperature or flames for a moment. However, sufficient protection against flames has been hardly obtained by these cloths. For example, in the case of flameproofed cotton or wool cloth, it has a low carbonization temperature and is easily carbonized by contacting with flames for a short period of time in spite of its excellent flameproofing property. In addition, since the carbonized part of the cloth has low strength and brittle, such a part is torn in a hole only by slightly applying force.

Although wholly aromatic polyamide fibers have extremely excellent heat resistance and fire retardancy, they shrink remarkably upon contact with flames. Spontaneously, cloth of these fibers is torn in a hole at the flame-contacted part.

Thus, these cloths have such a defect that they are easily torn in a hole at a flame-contacted part in spite of their excellent flameproofness and fire retardancy. This indicates that there may be a great danger of flame invasion from a hole upon contact with flames, when such cloth is used at places where a person may be exposed to a high temperature or flamed for a moment.

Although cloths of uniformly blended yarns of wholly aromatic polyamide fibers and cellulosic fibers with or without flameproofing are put into practical use, such cloths have defects that strength of cloths become low after contact with flames; cloths can not be dyed uniformly because wholly aromatic polyamide fibers are disposed on their surfaces; they have low light-resistance because color of wholly aromatic polyamide fibers is changed by exposure to sunlight; and they lack hand and drape required for clothes to be put on the body.

OBJECT OF THE INVENTION

The main object of the invention is to provide cloth which has the following characteristics:

(1) for a material for protection against flames used for clothes to be put on at places where a person may be exposed to a high temperature or flames for a moment, the cloth is hardly torn in a hole even upon contact with flames;

(2) the cloth maintains its required strength even after contact with flames;

(3) the cloth has excellent fastness to light; and (4) the cloth can be easily and uniformly dyed, and has excellent hand and drape as well as comfortableness (to wear).

This object as well as other objects and advantages of the present invention will become apparent to those skilled in the art from the following description with reference to the accompanying drawing.

SUMMARY OF THE INVENTION

Figure 1:
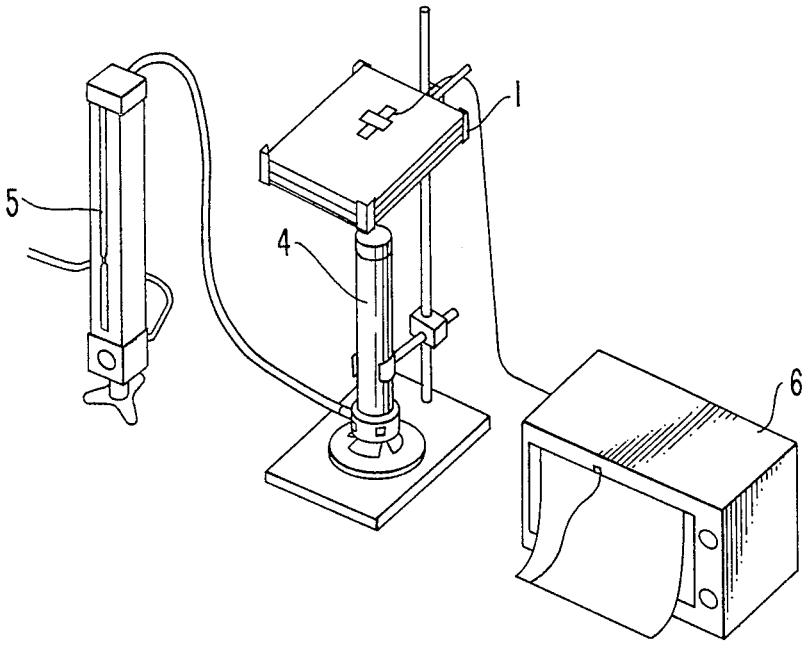
FIG. 1 is a perspective of an apparatus used herein for determination of protective property against flames.

According to the present invention, there is provided cloth for protection against flames which comprises woven or knitted composite yarns wherein wholly aromatic polyamide fibers of a general formula:

$$-NHAr_1NHCOAr_2Co-\text{and/or}$$

$$-NHRa_3CO-$$

$Ar_1$, $Ar_2$ and $Ar_3$ are independently bivalent aromatic groups, respectively, are disposed as cores and flameproofed cellulosic fibers and/or wool fibers are disposed around said cores.

The cloth for protection against flames of the present invention is not torn in a hole by shrinkage and is not broken by slightly applying force upon contact with flames. Therefore, it has excellent protective property against flames when it is used for clothes to be put on at places where a person may be exposed to a high temperature or flames for a moment.

DETAILED DESCRIPTION OF THE INVENTION

The wholly aromatic polyamide fibers used in the present invention are those at least 85 mole % of amide bonds of which are formed from the reaction of aromatic diamine and aromatic dicarboxylic acid components. Examples of thereof include polyparabenzamide, polyparaphenyleneterephthalamide, poly-4,4'-diaminobenzanilideterephthalamide, polyparaphenylene-2,6-naphthalicamide, copolyparaphenylene/4,4'-(3,3'-dimethyl-biphenylene)terephthalamide, copolyparaphenylene/2,5-pyridyleneterephthalamide, polyorthophenylenephthalamide, polymetaphenylenephthalamide, polyparaphenylenephthalamide, polyorthophenyleneisophthalamide, polymetaphenyleneisophthalamide, polyparaphenyleneisophthalamide, polyorthophenyleneterephthalamide, polymetaphenyleneterephthalamide, poly-1,5-naphthalenephthalamide, poly-4,4'-diphenyleneorthophthalamide, poly-4,4'-diphenyleneisophthalamide, poly-1,4-naphthalenephthalamide, poly-1,4naphthaleneisophthalamide, poly-1,5-naphthaleneisophthalamide and the like; these aromatic diamines whose part of benzene nucleuses are substituted by halogens; aromatic polyamides containing alicyclic amines such as compounds obtain by substituting a part of benzene nucleuses of the above aromatic diamines with piperazine, 2,5-dimethylpiperazine, 2,5-diethylpiperazine and the like; aromatic polyamides wherein aromatic diamines contains 2 phenyl groups bound through groups such as alkyl group, —S—, —$S0_2$—, —CO—, —NH- —and the like such as 3,3'-oxydiphenylenediamine, 3,4'-oxydiphenylenediamine and the like; and copolymers of the above aromatic polyamides, for example, poly-3,3'-oxydiphenyleneterephthalamide/polyparaphenyleneterephthalamide copolymer, poly-3,4'-oxydiphenyleneterephthalamide/polyparaphenyleneterephthalamide copolymer and the like. Preferably, the wholly aromatic polyamide fibers used in the present invention are meta-wholly aromatic polyamide fibers and, particularly, they are metawholly aromatic fibers synthesized from metaphenylenediamine and isophthalate chloride, for example, Nomex (manufactured by DuPont de Nemours and Co.) and the like.

The wholly aromatic polyamide fibers can be used in any form such as filaments or staple fibers.

The flameproofed cellulosic fibers used in the present invention are cotton, rayon, polynosic fibers or mixed fibers of these fibers and other fibers wherein 1.0 to 5.0% by weight of phosphorus and 0.5 to 3.0% by weight of nitrogen based on the weight of the fibers weight are added, and have a limited oxygen index value (LOI value) of not less than 0.25, preferably, not less than 0.27. Flameproofed cotton fibers are Preferred.

Flame-retarded rayon or polynosic fibers are those obtained by adding a polyphosphonate compound having a molecular weight of 500 to 10,000 to a spinning solution for preparing viscose man-made fibers such as, for example, that described in Japanese Patent Kokoku No. 48-2693 (5 to 20% by weight based on the weight of fiber yarns), and spinning according to a conventional method. Of course, phosphorus and nitrogen may contain in the same molecule.

Flame-retarded cotton is that post-processed with a phosphorus and/or nitrogen containing flame-retardant compound.

The post-processing can be carried out in the form of cotton before compounding with wholly aromatic polyamide fibers, or in the form of composite yarns or cloth compounded with wholly aromatic polyamide fibers. It is preferred to carry out the post-processing in the form of cloth woven or knitted with composite yarns compounded with wholly aromatic polyamide fibers.

When the amount of phosphorus added in the flameproofed cellulosic fibers of the present invention is less than 1.0% by weight, flameproofness becomes insufficient and the desired protective property against flames can not be obtained. On the other hand, when the amount of phosphorus added is more than 5.0% by weight, phosphorus added becomes too much, which results in an impediment to spinning property and lowering of hand and drape or strength. Addition of a nitrogen containing compound is effective for controlling the amount of a phosphorus compound within a suitable range.

Wool fibers used in the present invention may be conventional fibers and their LOI is also not less than 0.25, preferably, not less than 0.27. Flameproofing of the wool fibers can be carried out according to a conventional manner and post-processing can be also employed.

The wholly aromatic polyamide fibers and the flameproofed cellulosic or wool fibers are compounded in the form of composite yarns composed of cores of the wholly aromatic polyamide fibers and the outer layers of the flameproofed cellulosic or wool fibers formed about the cores. In order to compensate low light-resistance and dyeing properties of the wholly aromatic polyamide fibers, a ratio of covering the wholly aromatic polyamide fibers of the cores is of importance. It is necessary that the ratio is not less than 70%, preferably, not less than 80%. For this purpose, a ratio of the wholly aromatic polyamide fibers : the flame-retarded cellulosic or wool fibers to be compounded is 60:40 to 10:90, preferably, 50:50 to 20:80.

The composite yarns wherein the wholly aromatic polyamide fibers are disposed in the cores and flameproofed cellulosic or wool fibers are disposed about the cores can be obtained, for example, by the method disclosed in Japanese Patent Kokai No. 57-5924 which comprises supplying two kinds of slivers to a draft region of a roving frame, overlaying slivers being drafted with a partially drafted sliver fiber bundle, drafting both of them to obtain rovings having good coverage of the inner fibers with the outer fibers, and then spinning fibers into yarns with a spinning frame, or by the method which comprises twisting a bundle of the wholly aromatic polyamide filaments for the core, then winding cellulosic or wool fiber spun yarn round the core. Size of the composite yarns obtained is cotton count of 7 to 60, preferably, 10 to 40. In addition, the composite yarns may be in the form such that the cellulosic or wool fiber slivers are disposed about each bundle of the wholly aromatic polyamide long fibers, or cellulosic or wool fiber spun yarns are wound round each bundle of the wholly aromatic polyamide long fibers.

The cloth for protection against flames of the present invention is woven or knitted cloth of the above composite yarns, that is, woven cloth such as plain cloth, twill and the like or knitted cloth having weight of 100 to 500 g/m$^2$, preferably, 150 to 350 g/m$^2$ According to the present invention, by weaving or knitting cloth from the composite yarns wherein the wholly aromatic polyamide fibers are disposed as cores and flameproofed cellulosic or wool fibers are disposed as sheaths for the cores, the cellulosic and/or wool fibers which have excellent water vapor absorption and dyeing properties are concentrated on the surface layers of the yarns. Therefore, good comfortableness to wear of clothes can be imparted and the cloth can be dyed in desired color. Further, discoloration due to exposure to light can be prevented because the wholly aromatic polyamide fibers having low light resistance is covered with the cellulosic or wool fibers.

Furthermore, defects of both fibers compounded in the composite yarns are compensated each other to give good protection against flames. That is, flameproofed cellulosic and/or wool fibers prevent the wholly aromatic fibers from heat-shrinking upon contact with flames and the wholly aromatic polyamide fibers support a brittle carbonized part of flameproofed cellulosic and/or wool fibers. In particular, the core-sheath type structure of the composite fibers makes possible to retain the shape of cloth and keep most of original strength even if the cellulosic and/or wool fibers are carbonized by contacting with flames to lose their strength because the wholly aromatic polyamide fiber bundles which can keep strength are left as they are. On the other hand, in the case of cloth of uniformly blended yarns, when cellulosic and/or wool fibers are carbonized by contacting with flames, the function for binding the wholly aromatic polyamide fibers is lost, which results in the same phenomena as generation of voids in the texture-constituting yarns to markedly decrease strength of yarns or cloth, and therefore the cloth can hardly retain its shape even when force is slightly applied.

Thus, there is a remarkable difference of effects between the cloth of the present invention and cloth of uniformly blended yarns.

The following Examples and Comparative Examples further illustrate the present invention in detail but are not to be construed to limit the scope thereof.

In the Examples and Comparative Examples, determination of properties were carried out as follows.

(1) Protection against flames: The determination was carried out by using the apparatus as shown in FIGS. 1 and 2.

Figure 2:
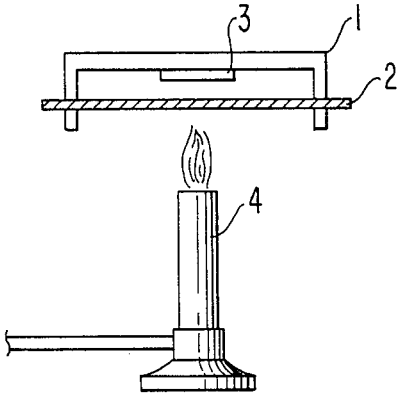
FIG. 2 is a schematic side view illustrating the relation between a sample, a burner and a flame detector of the apparatus of FIG. 1.

The apparatus shown in FIG. 1 has a sample holder 1 and a burner 4 put under the sample holder. The sample holder is connected to a temperature recorder 6 and the burner is connected to a gas flowmeter 5. As seen from FIG. 2, the sample holder 1 has a flame detector 3 which is faced to the burner 4 through a sample 2. The gas flowmeter controls the amount of heat from the burner.

The sample 2 was exposed to flames of the burner 4 for ten seconds. The average heat flow rate of the burner was set at 2.0 cal/cm$^2$.sec by the gas flowmeter 5. And, a rise in temperature after ten seconds was recorded by the flame detector 3 disposed above the sample (10 mm). After this determination, 1 kgf/5 cm or 1.8 kgf/5 cm of force was applied to the sample in the warp direction.

(2) Amount of phosphorus added To cellulosic fibers (% by weight): A colorimetry quantitative analysis was carried out according to ammonium molybdate method.

(3) Amount of nitrogen added to cellulosic fibers (% by weight): Semi-micro kjeldahl method was employed.

(4) Limited oxygen index (LOI) value: Only cellulosic fibers or wool fibers were taken out by unfixing the yarns, dispersing them in water, filtering and drying to obtain a nonwoven fabric sheet. This was measure according to the method of JIS-K-7201.

(5) Comfortableness: Micro climate within clothing was measured under environmental conditions of 20° C., 65% RH and 35° C. of the imitation skin temperature by using an apparatus for simulating climate in clothes (see Japanese Patent Application No. 56-119586) equipped with one sheet of a sample.

Example 1

By using as raw fibers the wholly aromatic polyamide fibers, Nomex (manufactured by DuPont de Nemours and Co.) of 1.5 denier and 38 mm in cut length and cotton fibers, two layer structured spun yarns (cotton count: 14) wherein Nomex fibers were disposed in the cores and cotton fibers were disposed about the cores were prepared according to the method of the above Japanese Patent Kokai No. 57-5924. The ratio of compounding the wholly aromatic polyamide fibers and cotton fibers in the yarns was 25/75 by weight. Then, the yarns were used to obtain twill fabric having the weight of 298 g/m$^2$ and the thread count of 110 warps and 50 wefts per inch which was desized, scoured and bleached according to a conventional method. The twill fabric was dipped into an aqueous solution containing 30% by weight of a flameproofing agent the active ingredient of which was N-methyloldimethylphosphonopropionic acid amide (Pyrobatex CP, manufactured by Ciba-Geigy Ltd.) and 0.5% by weight of ammonium chloride, and drawn so that wet pickup became 60%. The fabric was dried and heat-treated to obtain the desired cloth for protection against flames.

Example 2

Yarns of cotton count 40 were spun from the same raw fibers as in Example 1, Nomex (manufactured by DuPont de Nemours and Co.) of 1.5 denier and 38 mm in cut length. Spun yarns of cotton count 20 were prepared by winding yarns of cotton count 40 spun from the following flame retardant polynosic fibers round the cores of the above wholly aromatic polyamide yarns (the ratio of the wholly aromatic polyamide fibers and the flame retardant polynosic fibers: 50/50). From the yarns thus prepared, there was obtained twill fabric having a weight of 280 g/m$^2$ and the thread count of 108 warps and 58 wefts per inch, which was then desized, scoured, bleached according to a conventional method to obtain the desired cloth for protection against flames.

Raw flame retardant polynosic fiber: Polyorganophosphazen was added to a viscose spinning bath so that the amount of phosphorus in the bath was 2.8% by weight and spinning was carried out according to the method described in Japanese Patent Kokoku No. 48-2693.

Comparative Example 1

Uniformly blended yarns of cotton count 14 were prepared by using the same Nomex of 1.5 denier and 38 mm in cut length and cotton fibers as used in the above Example 1 at the blending ratio of 25/75. The yarns were used to obtain twill fabric having the weight of 290 g/m$^2$ and the thread count of 110 warps and 50 wefts per inch.

This fabric was dipped into an aqueous solution containing 30% by weight of a flameproofing agent the active ingredient of which was N-methyloldimethylphosphonopropionic acid amide (Pyrobotex CP, manufactured by Ciba-Geigy Ltd.) and drawn so that wet pickup became 60%. Then, the fabric was dried and heat-treated to obtain a comparative sample.

Comparative Example 2

A comparative cloth sample was obtained according to the same manner as described in Comparative Example 1 except that blending ratio of Nomex and cotton fibers was 50/50.

Comparative Example 3

A comparative sample of flameproofed cloth was obtained according to the same manner as described in Example 1 except that twill fabric of 100% cotton was used.

Comparative Example 4

A comparative cloth sample was obtained according to the same manner as described in Example 1 except that twill fabric of 100% Nomex was used.

Comparative Example 5

A comparative cloth sample was obtained according to the same manner as described in Example 1 except that flameproofing was not effected Properties of cloths obtained in Example 1 and 2, and Comparative Example 1 to 5 were evaluated. The results are summarized in Table 1.

TABLE 1

| | | Example 1 | Example 2 | Comparative Example 1 | Comparative Example 2 | Comparative Example 3 | Comparative Example 4 | Comparative Example 5 |
|---|---|---|---|---|---|---|---|---|
| Compounding ratio of wholly aromatic polyamide fibers and flameproofed cellulosic fibers | | 25/75 | 50/50 | 25/75 | 50/50 | 0/100 | 100/0 | 25/75 |
| Flame retardant cellulosic fibers | phosphorus wt % | 2.2 | 2.8 | 2.0 | 2.0 | 2.0 | — | — |
| | nitrogen wt % | 1.0 | 1.4 | 1.1 | 1.1 | 1.0 | — | — |
| Protection against flames °C. | | 18 | 20 | 20 | 23 | 300< | 300< | 300< |
| Break of cloth when contact with flames *1 (load per 5 cm width) | 1 kgf | o | o | o | x | x | x | x |
| | 1.8 kgf | o | o | x | x | x | x | x |
| Comfortableness (climate in clothes) | max. humidity (% RH) | 56.5 | 58.0 | 62.0 | 65.5 | 58.0 | 68.0 | 56.0 |
| | equilibrium humidity (% RH) | 48.0 | 48.5 | 56.0 | 55.5 | 50.0 | 62.0 | 47.0 |
| Light-fastness of dyed cloth *2 (rating) | | 4 | 4 | 2–3 | 2–3 | 4–5 | 1 | 4 |
| Dyeing properties *3 surface leveling | | o | o | x | x | o | — | o |
| LOI of flameproofed cellulosic fibers | | 29 | 30 | (29) *4 | (29) *4 | 30 | — | 18 |

*1 o: no break
x: broken
*2 Samples dyed with CI Basic Blue 47 on the Nomex side and with CI Vat Blue 6 on the cotton side were subjected to fademeter exposure at 63° C. for 20 hours and evaluated on grey scale (according to JIS-L-0842 method).
*3 Samples dyed with CI Vat Orange 2 on the cotton side were evaluated for surface leveling by naked eye.
o: good leveling
x: poor leveling
*4 estimation from N and P As seen from Table 1, the cloth of Example 1 or 2 is not torn in a hole or torn in to parts by contacting with flames and therefore a rise in temperature is little. Thus, it shows excellent protection against flames. Further, the cloth has better comfortableness in clothes due to low ultimate humidity and equilibrium humidity measured as climate in clothes as well as good dyeing properties and light-fastness.

In contrast with this, although the cloth of uniformly blended yarns of Comparative Example 1 has good protection against flames, it is inferior to the cloths of Examples 1 and 2 because cloth strength after contact with flames is low, and comfortableness judged by measurement of climate in clothes, light-fastness and dyeing properties are inferior.

In addition, the cloth of 100% flame retardant cellulosic fibers or 100% wholly aromatic polyamide fibers in Comparative Examples 3 and 4 is not acceptable as cloth for protection against flames because it is torn in a hole by contacting with flames and a rise in temperature is great.

Example 3

Yarns of cotton count 60 were spun from raw fibers of Nomex (manufactured by DuPont de Nemours and Co.) of 1.5 denier and 51 mm in cut length. Spun yarns of cotton count 24 were prepared by winding yarns of cotton count 40 spun from the following flameproofed wool fibers round the cores of the above wholly aromatic polyamide yarns (the ratio of the wholly aromatic polyamide fibers and the flameproofed wool fibers: 30/70). From the yarns thus prepared, there was obtained twill fabric having a weight of 320 g/m$^2$ and the thread count of 112 warps and 51 wefts per inch, which was then desized, scoured, bleached according to a conventional method to obtain the desired cloth for protection against flames.

Raw flameproofed wool fiber: Zirpro flameproofing was employed. Wool fibers were treated in an Overmiyer with a flameproofing agent solution containing 6.6% by weight of potassium fluorotitanium and 4% by weight of citric acid and adjusted to pH 2 with hydrochloric acid at 70° C. for 1 hour. The bath ratio was 1:10. Then, the fibers were washed water and dried.

Comparative Example 6

Cloth was prepared according to the same manner as described in Example 3 except that flameproofing was not effected.

Comparative Example 7

Cloth was prepared according to the same manner as described in Example 3 except that the fabric of 100% flameproofed wool fibers was used.

Properties of cloths obtained in Example 3 and Comparative Examples 6 and 7 were evaluated. The results are summarized in Table 2.

TABLE 2

| | | Example 3 | Comparative Example 6 | Comparative Example 7 |
|---|---|---|---|---|
| Compounding ratio of wholly aromatic polyamide fibers and flameproofed wool fibers | | 30/70 | 30/70 | 0/100 |
| LOI of flame proofed wool | | 0.33 | 0.24 | 0.33 |
| Protection against flames °C. | | 17 | 300< | 300< |
| Break of cloth when contact with flames *1 (load per 5 cm width) | 1 kgf | o | x | x |
| | 1.8 kgf | o | x | x |
| Comfortableness (climate in clothes) | max. humidity (% RH) | 56.5 | 56.0 | 58.5 |
| | equilibrium | 48.5 | 48.5 | 49.0 |

TABLE 2-continued

| | Example 3 | Comparative Example 6 | Comparative Example 7 |
|---|---|---|---|
| humidity (% RH) | | | |

*1 The same as in Table 1

What is claimed is:

1. Cloth for protection against flames which comprises woven or knitted composite yarns wherein wholly aromatic polyamide fibers of a general formula:

$$—NHAr_1NHCOAr_2CO—\pi \text{and/or}$$

$$-NHAr_3CO—$$

$Ar_1$, $Ar_2$ and $Ar_3$ are independently bivalent aromatic groups, respectively, are disposed as cores and flameproofed cellulosic fibers and/or flameproofed wool fibers are disposed around said cores.

2. The cloth according to claim 1, wherein the flameproofed cellulosic or flameproofed wool fibers have a LOI value of not less than 0.25.

3. The cloths according to claim 2, wherein flameproofness of the cellulosic fibers or wool fibers are imparted by postprocessing.

4. The cloth according to claim 2, wherein the flameproofed cellulosic fibers are flame-retarded low-modulus rayon fibers 5. The cloth according to claim 1, wherein flameproofness of the cellulosic fibers or wool fibers are imparted by post-processing.

6. The cloth according to claim 1, wherein the flameproofed cellulosic fibers are flame-retarded polynosic fibers.

7. The cloth according to claim 1, wherein the flameproofed cellulosic fibers are flame-retarded low-modulus rayon fibers.

* * * * *